US011771165B2

(12) United States Patent
Kwok

(10) Patent No.: US 11,771,165 B2
(45) **Date of Patent: *Oct. 3, 2023**

(54) HELMET WITH FLEXIBLE STRUCTURE FOR IMPROVED FORCE ATTENUATION

(71) Applicant: ZAM Helmets Inc., Redwood City, CA (US)

(72) Inventor: Whitman Kwok, Emerald Hills, CA (US)

(73) Assignee: ZAM Helmets Inc., Redwood City, CA (US)

( * ) Notice: Subject to any disclaimer, the term of this patent is extended or adjusted under 35 U.S.C. 154(b) by 891 days.

This patent is subject to a terminal disclaimer.

(21) Appl. No.: 16/676,482

(22) Filed: Nov. 7, 2019

(65) Prior Publication Data

US 2020/0068978 A1 Mar. 5, 2020

Related U.S. Application Data

(63) Continuation of application No. 15/396,126, filed on Dec. 30, 2016, now Pat. No. 10,499,700.

(51) Int. Cl.
*A42B 3/06* (2006.01)
*A42B 3/08* (2006.01)
(Continued)

(52) U.S. Cl.
CPC ..... *A42B 3/065* (2013.01); *A42B 3/064* (2013.01); *A42B 3/069* (2013.01); *A42B 3/08* (2013.01);
(Continued)

(58) Field of Classification Search
CPC .. A42B 3/22; A42B 3/06; A42B 3/064; A42B 3/069; A42B 3/121; A42B 3/08; A42B 3/20; A42B 3/125
See application file for complete search history.

(56) References Cited

U.S. PATENT DOCUMENTS 1,049,970 A * 1/1913 Kwok ..... B63B 23/04 114/373
3,174,155 A 3/1965 Pitman
(Continued)

FOREIGN PATENT DOCUMENTS

| | | |
|---|---|---|
| CA | 2645971 C | 4/2016 |
| CA | 3002414 A1 | 5/2017 |
| CA | 2990250 A1 | 6/2018 |

OTHER PUBLICATIONS

"U.S. Appl. No. 15/396,126, Non Final Office Action dated Feb. 7, 2019", 8 pgs.

(Continued)

*Primary Examiner* — Gloria M Hale
(74) *Attorney, Agent, or Firm* — Schwegman, Lundberg & Woessner, P.A.

(57) ABSTRACT

A helmet includes a shell, a brim, ridges, and multiple flexible structures. The shell is shaped to receive a user's head. The brim covers the user's forehead and areas above the temples and ears and protrudes from the outer surface of the shell. The ridges are located along the back and top of the helmet and also protrude from the outer surface of the shell. The flexible structures, which are made of a material that is more flexible than the shell, the brim, and the ridges, are positioned in separation gaps between the shell and the brim and ridges. The shell, brim, ridges, and flexible structures are fused together as a single unibody. When the helmet is subjected to an impact on the brim or the ridges, the corresponding flexible structure deforms so that the brim or ridge moves relative to the shell. The deformation of the flexible structure attenuates the force of the impact, which improves the helmet's ability to protect the user from impacts.

16 Claims, 11 Drawing Sheets

(51) Int. Cl.
*A42B 3/12* (2006.01)
*A42B 3/20* (2006.01)
*A42B 3/22* (2006.01)

(52) U.S. Cl.
CPC ..... *A42B 3/121* (2013.01); *A42B 3/125* (2013.01); *A42B 3/20* (2013.01); *A42B 3/22* (2013.01)

(56) References Cited

U.S. PATENT DOCUMENTS

| | | | |
|---|---|---|---|
| 6,272,692 | B1 | 8/2001 | Abraham |
| 6,360,376 | B1 | 3/2002 | Carrington |
| 6,537,660 | B2 | 3/2003 | Katayama et al. |
| 6,857,935 | B1 | 2/2005 | Dohan |
| 8,191,179 | B2 | 6/2012 | Durocher et al. |
| 8,826,468 | B2 | 9/2014 | Harris |
| 10,178,889 | B2 | 1/2019 | Wacter et al. |
| 2006/0112477 | A1 | 6/2006 | Schneider |
| 2012/0015663 | A1 | 1/2012 | Cho et al. |
| 2015/0282550 | A1 | 10/2015 | Musal |
| 2016/0113348 | A1 | 4/2016 | Twardowski, Jr. et al. |
| 2016/0227867 | A1 | 8/2016 | Twardowski et al. |
| 2018/0184744 | A1* | 7/2018 | Kwok ..... A42B 3/065 |

OTHER PUBLICATIONS

"U.S. Appl. No. 15/396,126, Notice of Allowance dated Aug. 7, 2019", 6 pgs.
"U.S. Appl. No. 15/396,126, Response filed Apr. 22, 2019 to Non Final Office Action dated Feb. 7, 2019", 11 pgs.
"Canadian Application Serial No. 2,990,250, Office Action dated Nov. 5, 2018", 4 pgs.

* cited by examiner

HELMET WITH FLEXIBLE STRUCTURE FOR IMPROVED FORCE ATTENUATION

PRIORITY APPLICATION

The present application is a continuation of U.S. patent application Ser. No. 15/396,126 filed Dec. 30, 2016, now U.S. Pat. No. 10,499,700; the entire contents of which are incorporated herein by reference.

BACKGROUND

This disclosure generally relates to protective headgear and more particularly to a helmet with a flexible structure incorporated into the outer layer.

Conventional helmets include two primary components—a rigid outer layer and a compressible inner layer—that perform two non-overlapping functions. The rigid outer layer is made of an inflexible material and covers a user's head. The compressible inner layer is made of a softer material, typically a type of padding or foam, and is positioned between the rigid outer layer and the user's head. When a helmet with this structure is subjected to an impact, the rigid outer layer disperses the force of the impact over a broader area. However, because the outer layer is made of an inflexible material, the outer layer does not flex or deform in any significant manner when subjected to an impact. As a result, the rigid outer layer transfers nearly the entire force of the impact to the compressible inner layer, and the compressible inner layer is the only component of the helmet that attenuates the force of the impact. A helmet's rigid outer layer typically has the minimum thickness needed to provide rigidity for the purpose of dispersing the anticipated impact forces of the activity for which the helmet is designed. The thickness of a helmet's compressible inner layer is typically limited by broader design goals like reducing the overall size and weight of the helmet, and this leads to limited attenuation of the impact force relative to what would cause a mild traumatic brain injury (e.g., a concussion).

This limitation is compounded by helmets for certain sports, such as hockey and lacrosse, which typically have a rigid outer layer with ridges and bumps that protrude outward from the user's head. These ridges and bumps act as I-beams that add additional rigidity to the outer layer, which can decrease the effectiveness of the portion of the compressible inner layer positioned directly below the ridges and bumps. Specifically, the ridges and bumps direct impact forces through these I-beams, bypassing the attenuation material in the cavity of these protrusions, which in turn further limits the attenuation of the impact force by the helmet.

SUMMARY

A helmet includes a shell, a brim, and a flexible structure fused together to act as a single body. The shell is shaped to receive a user's head. The brim protrudes from the outer surface of the shell and is typically located in a position corresponding to the user's forehead and optionally proceeding around each side near the temples and ears. The flexible structure is positioned in a separation gap between the brim and the shell and has a higher flexibility than the brim and the shell.

The shell, brim, and flexible structure may be formed of a first material, a second material, and a third material, respectively. The first material and the second material are relatively rigid materials, such as ABS (acrylonitrile butadiene styrene), PC (polycarbonate) or a co-polyester derivative, while the third material is a more flexible material, such as TPU (thermoplastic polyurethane), TPE (thermoplastic elastomer), soft PLA (polylactic acid), or rubber. The first material and the second material may be the same.

When the helmet is subjected to an impact on the brim, the flexible structure deforms so that the brim moves relative to the shell. Although the helmet may also include a compressible inner layer that compresses to help attenuate the force of the impact, the deformation of the flexible structure provides an additional mechanism for the helmet to attenuate the force of an impact by extending the time of a given impact and therefore lowering the overall rate of acceleration experienced by the player's head. In this design, any compressible material directly under the brim takes part in attenuating impacts, unlike a conventional helmet. At the same time, the brim typically does not move below the plane of the shell below it, which means it does not bottom out on the user's head. The fact that the compressible inner layer and the flexible structure can both operate to attenuate the force of an impact advantageously increases the helmet's overall ability to protect the user from head trauma associated with high-G impacts.

DETAILED DESCRIPTION

Figure 1A:
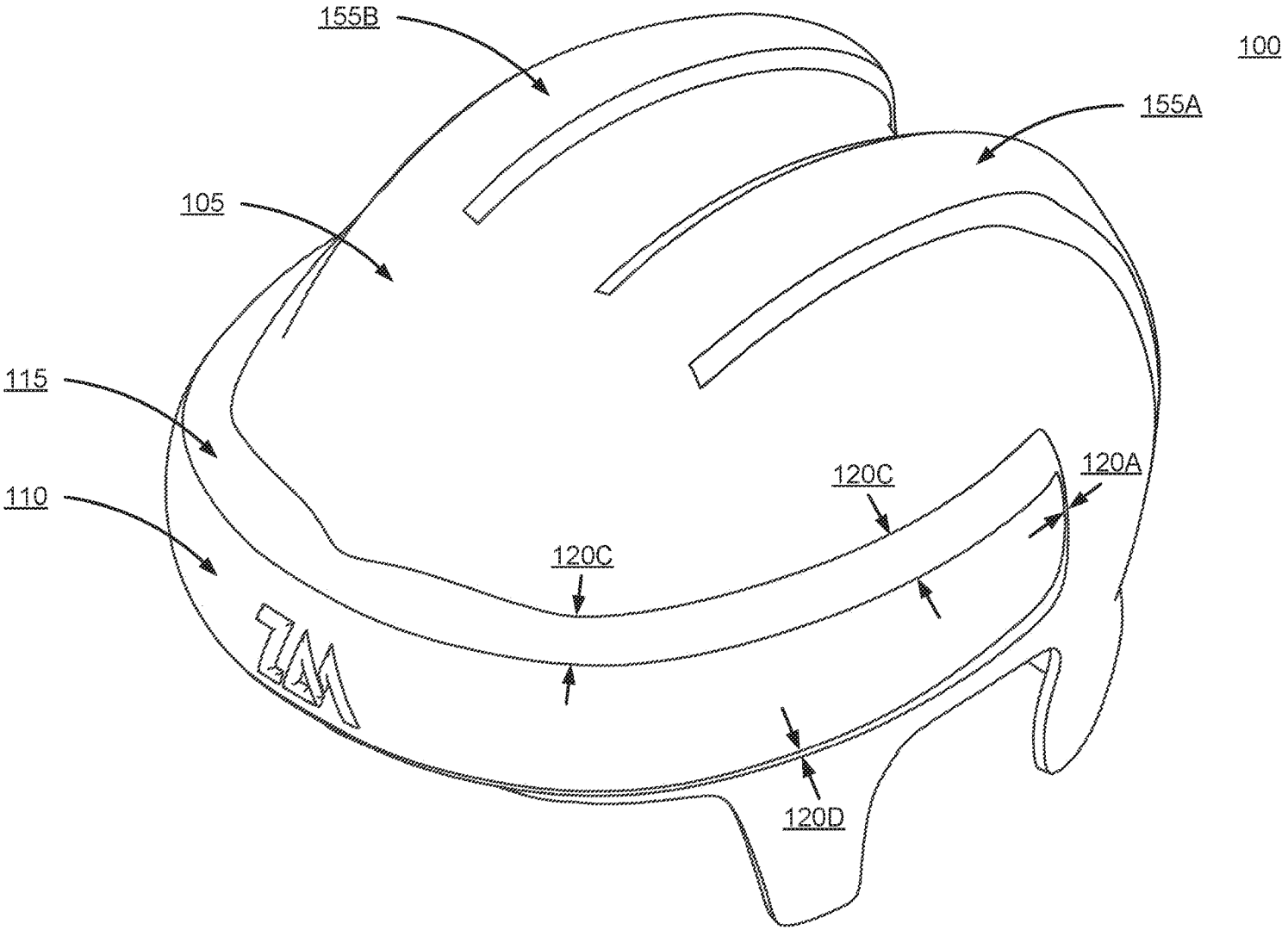
FIG. 1A is a front perspective view of a helmet, according to one embodiment.

A helmet includes a shell, a brim, and a flexible structure. The shell is shaped to receive a user's head. The brim protrudes from the outer surface of the shell, covers the user's forehead, and extends to the sides of the head to the area corresponding to the user's temples and ears. The flexible structure, which is made of a material that is more flexible than the shell and the brim, joins the brim to the shell by filling a separation gap between the shell and the brim. The portion of the helmet that covers the rear of the user's head includes ridges that also protrude from the outer surface of the shell, and additional flexible structures join the ridges to the shell by filling a separation gap between the shell and the ridges. When the helmet is subjected to an impact on the brim or the ridges, the corresponding flexible structure deforms so that the brim or ridge moves relative to the shell. As described herein, deformation refers to any change in shape, either temporary or permanent, in a material or component resulting from physical pressure or stress. The deformation of the flexible structure attenuates the force of the impact, which improves the helmet's ability to protect the user from impacts.

FIGS. 1A-1E illustrate various views of a helmet 100, according to one embodiment of the invention. In the embodiment shown in FIGS. 1A-1E, the helmet 100 includes, among other elements, a shell 105 formed of a first material, a brim 110 formed of a second material, and a flexible structure 115 formed of a third material. The helmet further includes two ridges 155A, 155B along its top and rear. The structure and function of the ridges 155A. 155B are described in further detail with reference to FIGS. 4A-4B and 5A-5B. In addition to the components described herein, the helmet 100 can also include additional components not shown in the figures. For example, the helmet 100 may include a compressible inner layer (e.g., made of one or more pieces of foam, padding, or air vessels) positioned between the shell and the user's head that helps attenuate the force of impacts to the head. Other examples of additional components include a chin strap that keeps the helmet 100 secure on the user's head, a fit system that clamps around the head to secure it on the user's head, and a face covering, such as a visor, face shield, or cage, that protects part or all of the user's face.

As described herein, the first material (i.e., the material used for the shell) and the second material (i.e., the material used for the brim) are materials with a high rigidity and a high impact resistance. For example, the first and second materials may be acrylonitrile butadiene styrene (ABS), polycarbonate (PC), or a co-polyester derivative. In some embodiments, the first and second materials are the same material. In other embodiments, the first and second materials are different materials to accommodate different impact scenarios and anticipated forces specific to the location of the helmet. For example, the first material is a type of ABS while the second material is a type of polycarbonate. As another example, the first material is one type of polycarbonate and the second material is a different type of polycarbonate.

As described herein, the third material (i.e., the material used for the flexible structure) is a material with a higher flexibility than the first and second materials. In addition, the third material may also have a relatively low stiffness (e.g., a Young's modulus below 50 MPa), a high elongation at break (e.g., greater than 100%), an ultimate tensile strength of at least 20 MPa, and a high fatigue limit (e.g., at least 10.000 cycles when tested at half the ultimate tensile strength of the third material). For example, the third material may be thermoplastic polyurethane (TPU), thermoplastic elastomer (TPE), soft polylactic acid (soft PLA), or rubber.

In other embodiments, the shell 105 may be formed of multiple materials that have the characteristics described with reference to the first material and the second material. For example, the shell 105 may comprise an inner core made of a type of ABS covered on all surfaces with a layer of a different type of ABS. This allows the surfaces of the shell 105 to be formed of a material with some additional favorable characteristic (e.g., higher scratch resistance, more easily pigmented) while the core of the shell 105 may be formed of a material with more favorable mechanical properties (e.g., higher rigidity, lighter weight). For similar reasons, the brim 110 may also be formed of multiple materials that have the characteristics described with reference to the first material and the second material, and the flexible structure 115 may be formed for multiple materials that have the characteristics described with reference to the third material.

Figure 1B:
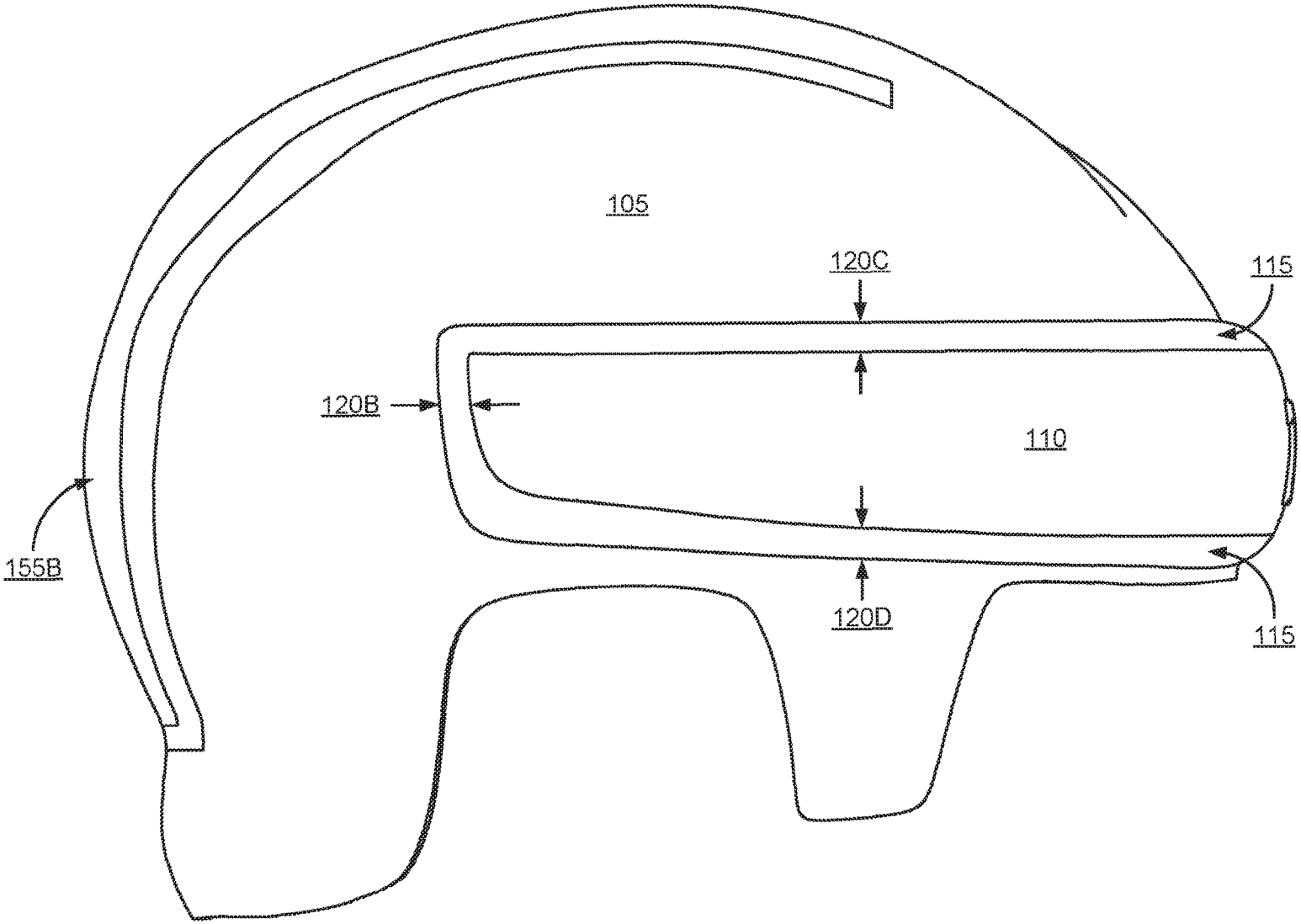
FIG. 1B is a right side view of the helmet of FIG. 1A, according to one embodiment.
Figure 1C:
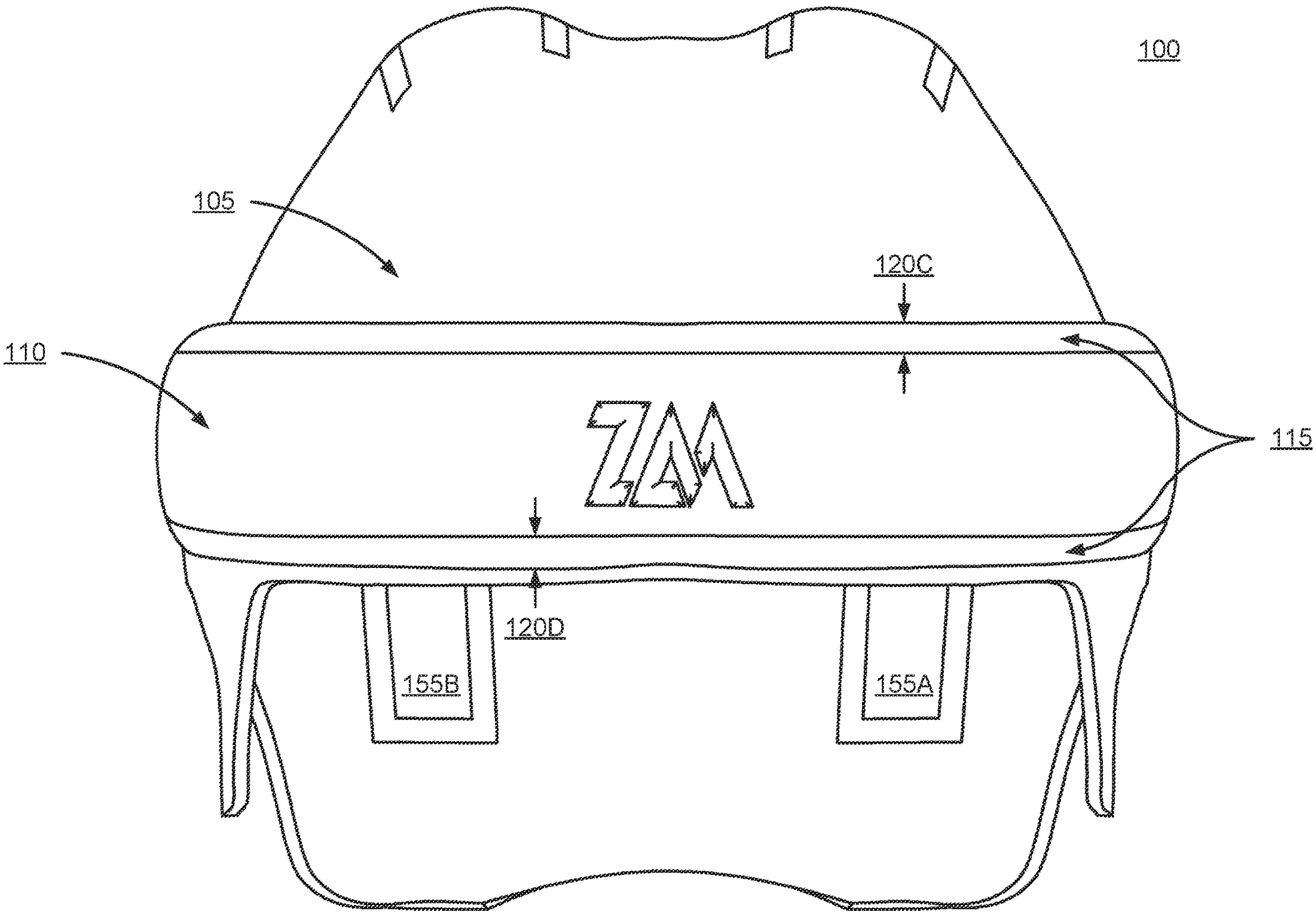
FIG. 1C is a front view of the helmet of FIG. 1A, according to one embodiment.

FIGS. 1A, 1B, and 1C illustrate a front perspective view, a right side view, and a front view, respectively, of the helmet 100. Because these three figures illustrate various views of the same components (e.g., the shell 105, the brim 110, and the flexible structure 115), certain aspects of these components will be described below with reference to all three of these figures.

The shell 105 is shaped to receive a user's head. For example, the shell 105 has a shape that substantially matches the curvature of a human head. Because head dimensions may vary between users, the shape of the shell 105 may vary between different embodiments of the helmet 100 so that different embodiments can accommodate different groups of users. For example, the size of the shell 105 may vary between different embodiments of the helmet 100 to accommodate users with larger or smaller heads. As another example, different embodiments of the helmet 100 may have a shell 105 with the same circumference but with a different width-to-length ratio in order to accommodate different head shapes.

The brim 110 is joined to the shell 105 by the flexible structure 115. The brim 110 is sized and shaped so that there is a separation gap 120A through 120D (collectively referred to as the separation gap 120) between the brim and the shell, and the flexible structure 115 is sized and shaped so that it occupies the separation gap 120. In the illustrated embodiment, the shell 105 and the brim 110 are separate pieces of material. In this embodiment, the shell 105 has an elongated cutout at a position corresponding to the user's forehead and temples, and the brim 110 is sized to fit in the cutout so that the separation gap 120 surrounds the brim 110 along all four edges of the brim 110. Specifically, the brim 110 in this embodiment has a left vertical edge (adjacent to the left separation gap 120A), a right vertical edge (adjacent to the right separation gap 120B), a top horizontal edge (adjacent to the top separation gap 120C), and a bottom horizontal edge (adjacent to the bottom separation gap 120D). The flexible structure 115 surrounds these four edges of the brim 110 and joins the edges of the brim 110 to the edges of the elongated cutout. Although the flexible structure 115 is illustrated in this embodiment as a single unitary piece, the flexible structure 115 may comprise multiple separate pieces. Likewise, the brim 110 and shell 105 may be joined directly to each other at one or more points along the separation gap 120 that would otherwise be occupied by the flexible structure 115.

In another embodiment, the left and right ends of the brim 110 are joined directly to the shell 105 with no separation gap or flexible structure 115 in between (i.e., the left separation gap 120A and the right separation gap 120B are omitted, and the brim 110 is instead joined directly to the shell 105 at these two places). Instead, the flexible structure 115 occupies two discrete separation gaps 120C, 120D adjacent to the top and bottom edges of the brim 110. In this embodiment, the brim 110 has a top horizontal edge (adjacent to the top separation gap 120C) and a bottom horizontal edge (adjacent to the bottom separation gap 120D) but does not have a left vertical edge or a right vertical edge.

Figure 1D:
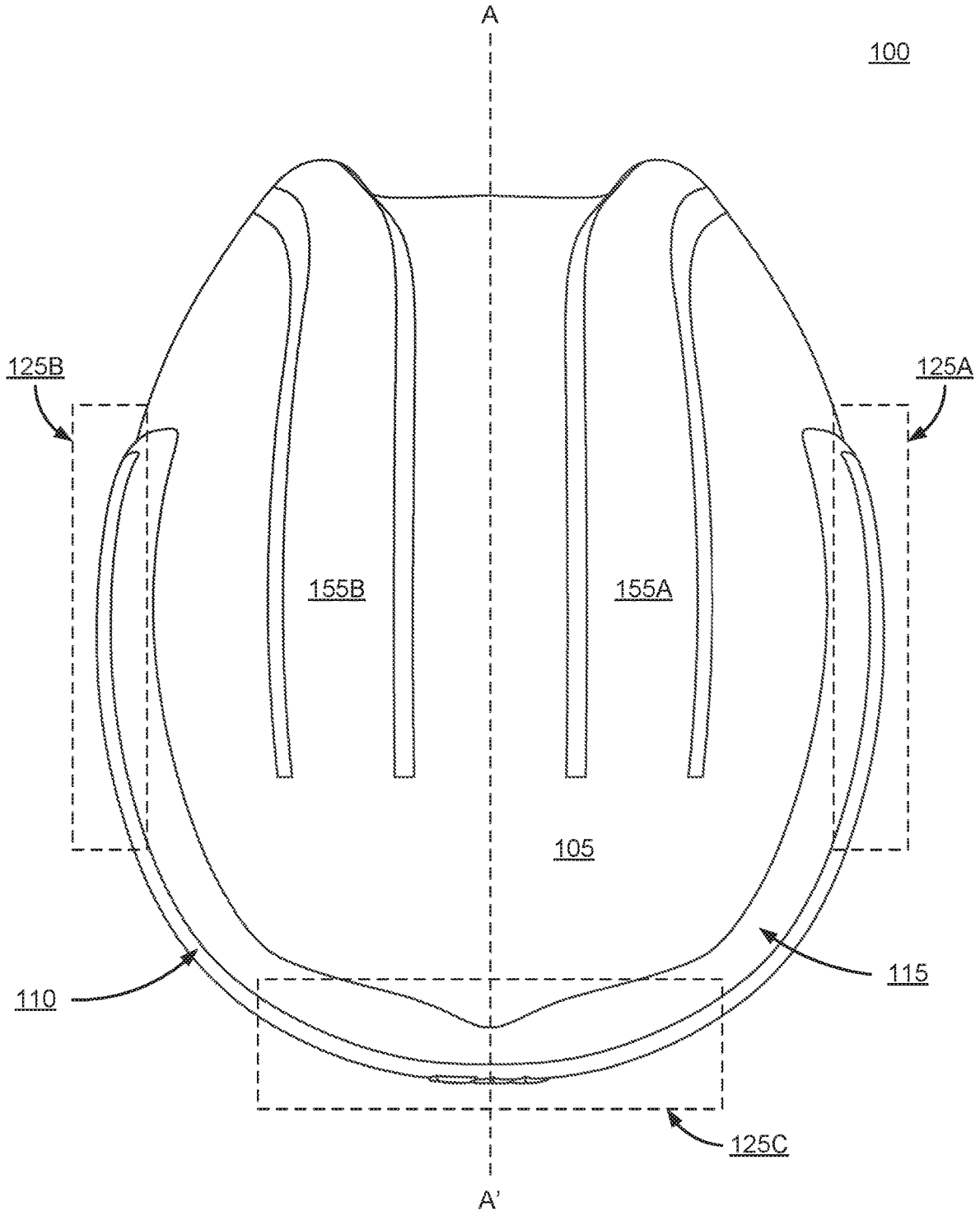
FIG. 1D is a top view of the helmet of FIG. 1A, according to one embodiment.

FIG. 1D illustrates a top view of the helmet 100. In the illustrated embodiment, the brim 110 has a curved and elongated shape that is similar to the curvature of the side portions and the front portion of the shell. In this embodiment, the brim 110 is a single continuous strip of the second material and includes a left portion 125A at a position covering the user's left temple, a right portion 125B at a position covering the user's right temple, and a center portion 125C at a position covering the user's forehead.

In other embodiments, the brim 110 may have a different structure. In one embodiment, the brim 110 comprises three separate pieces of the second material, with the first piece positioned to cover the user's left temple, the second piece positioned to cover the user's right temple, and the third piece positioned to cover the user's forehead. Each of these pieces may be curved in a manner similar to the curvature of the shell, or some or all of the pieces may be flat (which may simplify the manufacturing process by allowing for the use of off-the-shelf sheets of plastic). In this embodiment, the flexible structure 115 may fill separation gaps between the first, second, and third pieces of the brim 110 in addition to the separation gap between the brim 110 and the shell 105.

In another embodiment, the brim 110 comprises a different number of separate pieces (e.g., two pieces, four pieces, five pieces). In still another embodiment, the brim 110 covers the user's forehead but does not extend to the sides of the helmet 100 to cover the user's temples. For example, the brim 110 includes the center portion 125C shown in FIG. 1D but does not include the side portions 125A, 125B. In this embodiment, rectangular protrusions may be formed into the sides of the shell 110 to mimic the appearance of a brim that extends from the left temple to the right temple. In still another embodiment, the brim 110 extends farther toward to rear of the helmet 100. For example, the brim 110 may extend so that the left and right portions 125A. 125B nearly make contact with the ridges 155A, 155B. In still another embodiment, the helmet 100 includes multiple brims 110. For example, the helmet 100 may include a lower brim that covers the user's forehead and temples in a manner similar to the brim 110 in the illustrated embodiment in addition to an upper brim with a tighter curvature than the lower brim and positioned closer to the top of the user's head. An embodiment with the ridges arranged in this manner may be used, for example, as a lacrosse helmet.

Figure 1E:
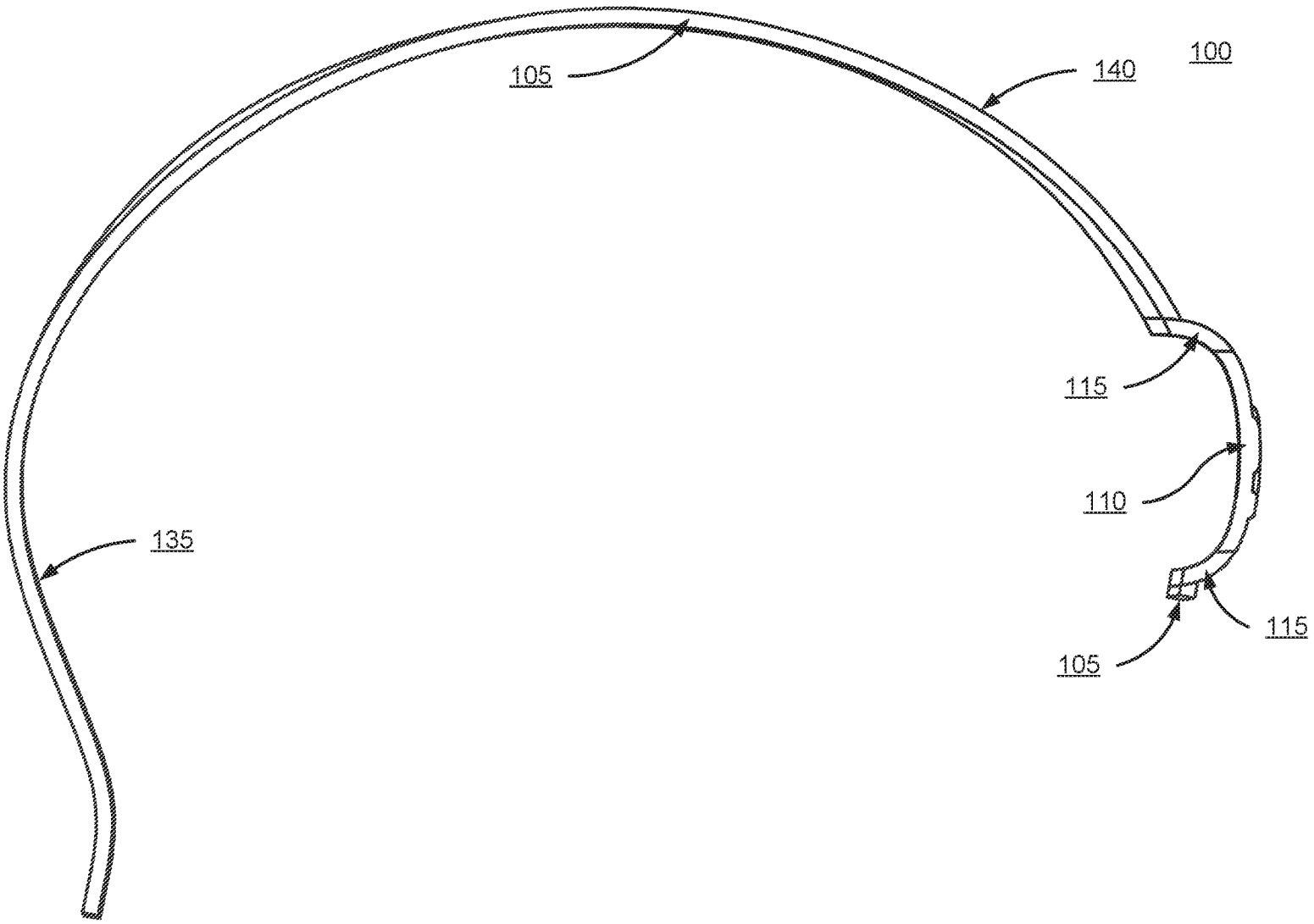
FIG. 1E is a cross-sectional view of the helmet taken along line A-A' of FIG. 1D, according to one embodiment.

FIG. 1E is a side cutaway view of the helmet 100 taken along the vertical dashed line A-A' shown in FIG. 1D. As noted above with reference to FIGS. 1A, 1B, and 1C, the shell 105 is shaped to receive a human head. As a result, the shell 105 has a concave inner surface 135 and a convex outer surface 140, as illustrated in FIG. 1E. The brim 110 is joined to the shell 105 via the flexible structure 115 in a manner that causes the brim 110 to protrude from the outer surface 140 of the shell 105. Because the brim 110 protrudes from the outer surface 140, an impact object is more likely to make contact with the brim 110 rather than the shell 105 when hitting the sides or the front of the helmet 100. Some of the advantages of having an impact make contact with the brim 110 are explained below with reference to FIG. 2.

In the illustrated embodiment, the shell 105 is formed of a solid piece of the first material. In other embodiments, the shell 105 may be formed of the first material but with a different internal structure. For example, the shell 105 may comprise two layers with pockets of air or a honeycomb structure sandwiched in between.

Figure 2:
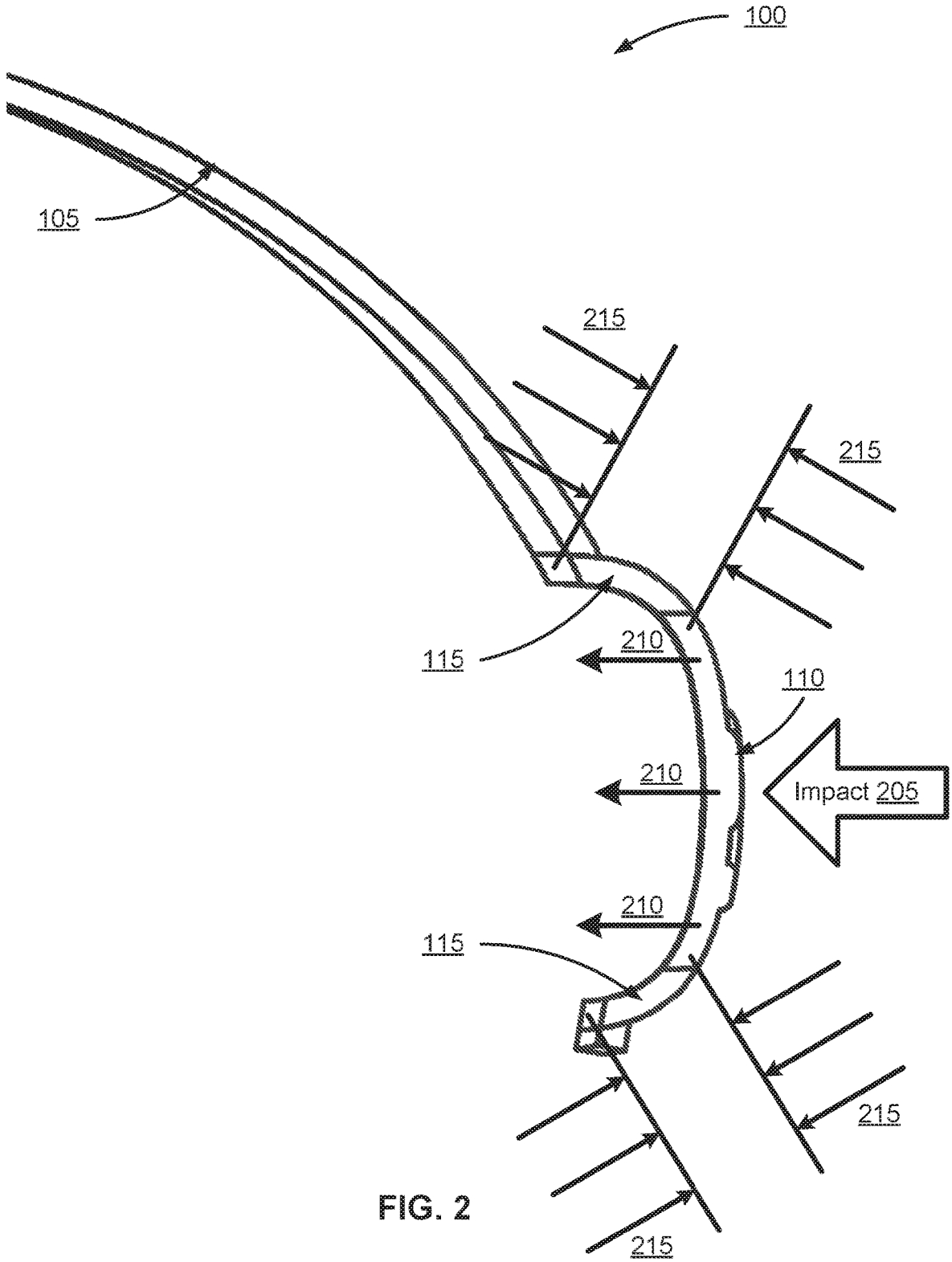
FIG. 2 is a cross-sectional view illustrating an example of a front impact on the brim of the helmet, according to one embodiment.

FIG. 2 is a cross-sectional view of the front portion of the helmet 100 illustrating an example of a front impact 205 on the brim 110 of the helmet 100. The front impact 205 can represent a broad area impact (e.g., a collision with another person's head, another person's body, or a fixed surface such as a floor, the ground, or a wall) or a small area impact (e.g., an impact by a projectile such as a puck or a collision with a fixed narrow object such as a pole or a beam). For example, the front impact 205 may occur if the user falls forward and his forehead hits the floor (i.e., a broad area impact). As another example, the front impact may occur if the user is playing as a goalie and is hit in the forehead with a hockey puck or lacrosse ball (i.e., a small area impact).

When the helmet 100 is subjected to the front impact 205 shown in FIG. 2, the impact 205 first makes contact with the front portion of the brim 110. The impact 205 causes the brim 110 to move in translation 210 toward the user's head (i.e., towards left as shown in FIG. 2). The motion 210, in turn, causes deformation in the flexible structure 115. Specifically, the motion 210 causes the portion of the flexible structure 115 adjacent to the front portion of the brim to compress 215. Although not shown in the cross sectional view of FIG. 2, the motion 210 may also cause the flexible structure 115 adjacent to the side portions of the brim 110 to shear. The deformation of the flexible structure 115 allows the brim 110 to move in translation relative to the shell 105 and thus reduces motion of the shell 105 and impact to the shell 105.

The deformation of the flexible structure 115 is advantageous, among other reasons, because it attenuates the force of the impact 205. While the helmet 100 may further include a compressible inner lining that also attenuates impact forces, the deformation of the flexible structure 115 also attenuates the impact force, meaning that the helmet 100 has a greater overall ability to attenuate impact forces. This advantageously causes the helmet 100 to transfer a smaller portion of the impact force to the user's head and leads to increased protection for the user.

Figure 3:
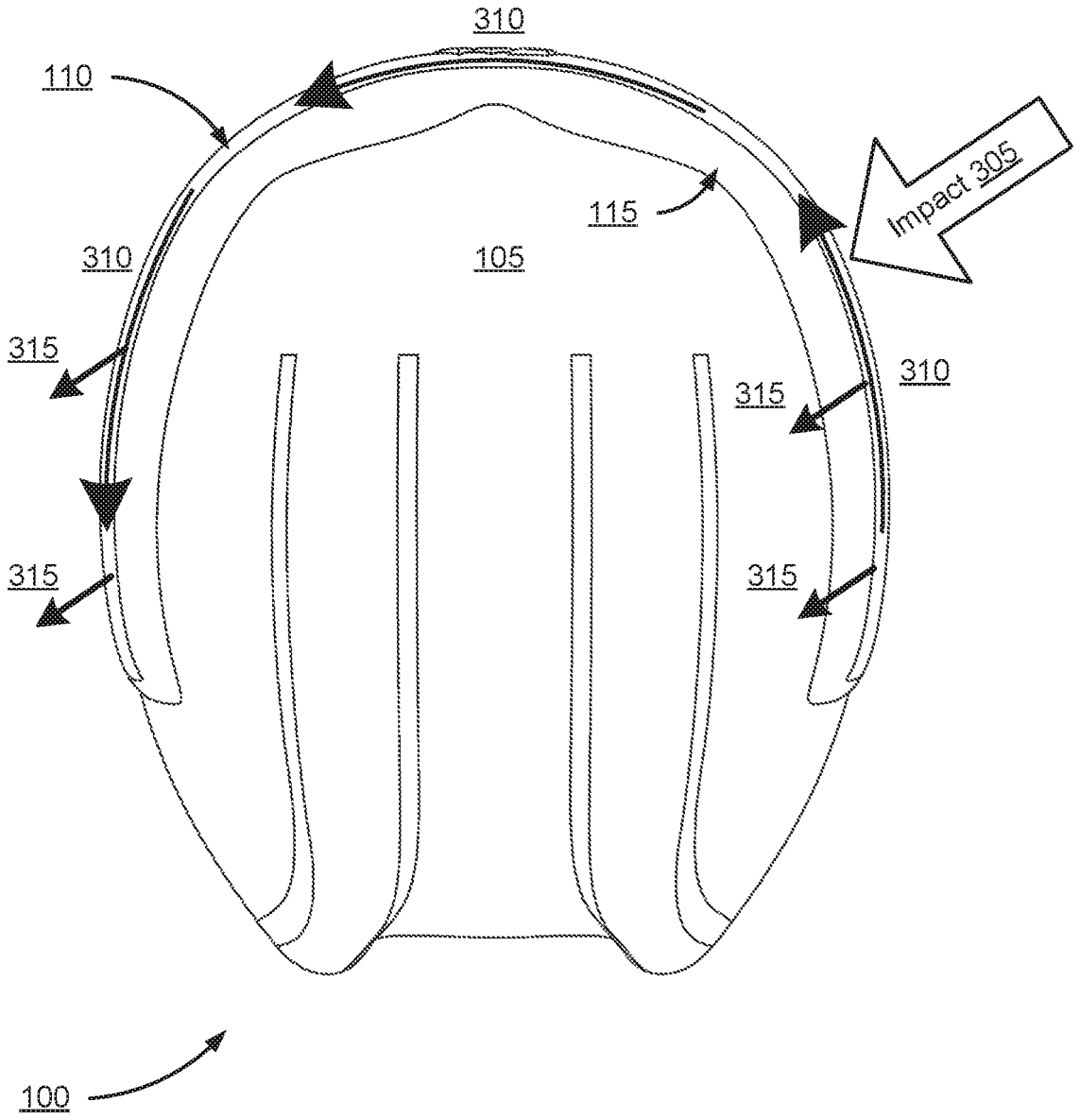
FIG. 3 is a top view illustrating a side impact on the brim of the helmet, according to one embodiment.

FIG. 3 is a top view illustrating a side impact 305 on the brim 110 of the helmet 100. For example, the impact 305 could represent a player being hit in the temple by a projectile, such as a hockey puck or lacrosse ball. A side impact like the impact 305 shown in FIG. 3 is one of the most dangerous injuries in modern-day contact sports because it can cause the user's head to move in both translation (e.g., to the left as shown in FIG. 3) and in rotation (e.g., counterclockwise as shown in FIG. 3).

When the helmet 100 is subjected to the side impact 305 shown in FIG. 1, the projectile makes contact with the right portion (shown in FIG. 1D as right portion 125B) of the brim 110. The impact 305 causes the brim 110 to make a rotational movement 310 counterclockwise about the user's neck and also causes the brim 110 to make translational movement 315 to the left and to the back of the user's head. Similar to the impact 205 shown in FIG. 2, the motion 310, 315 resulting from the impact 305 also causes deformation in flexible structure 115. The deformation allows the brim 110 to move in rotation and translation relative to the shell 105, which reduces the rotational and translational motion of the shell 105. Again, the deformation of the flexible structure 115 is advantageous, among other reasons, because it attenuates the force of the impact 305 and causes the helmet 100 to transfer a smaller portion of the impact's rotational and translational forces to the user's head.

Figure 4A:
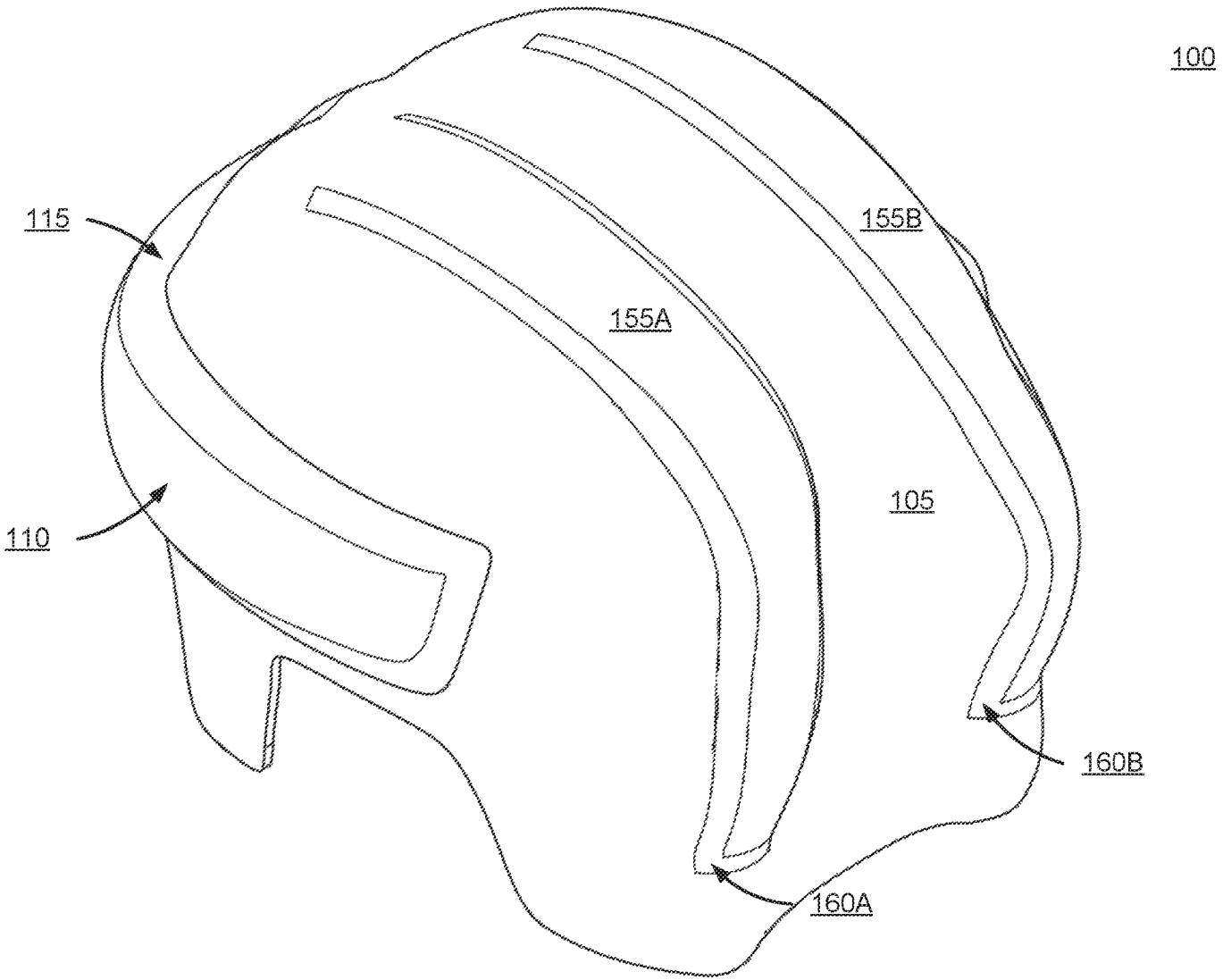
FIG. 4A is a rear perspective view of the helmet of FIG. 1A, according to one embodiment.
Figure 4B:
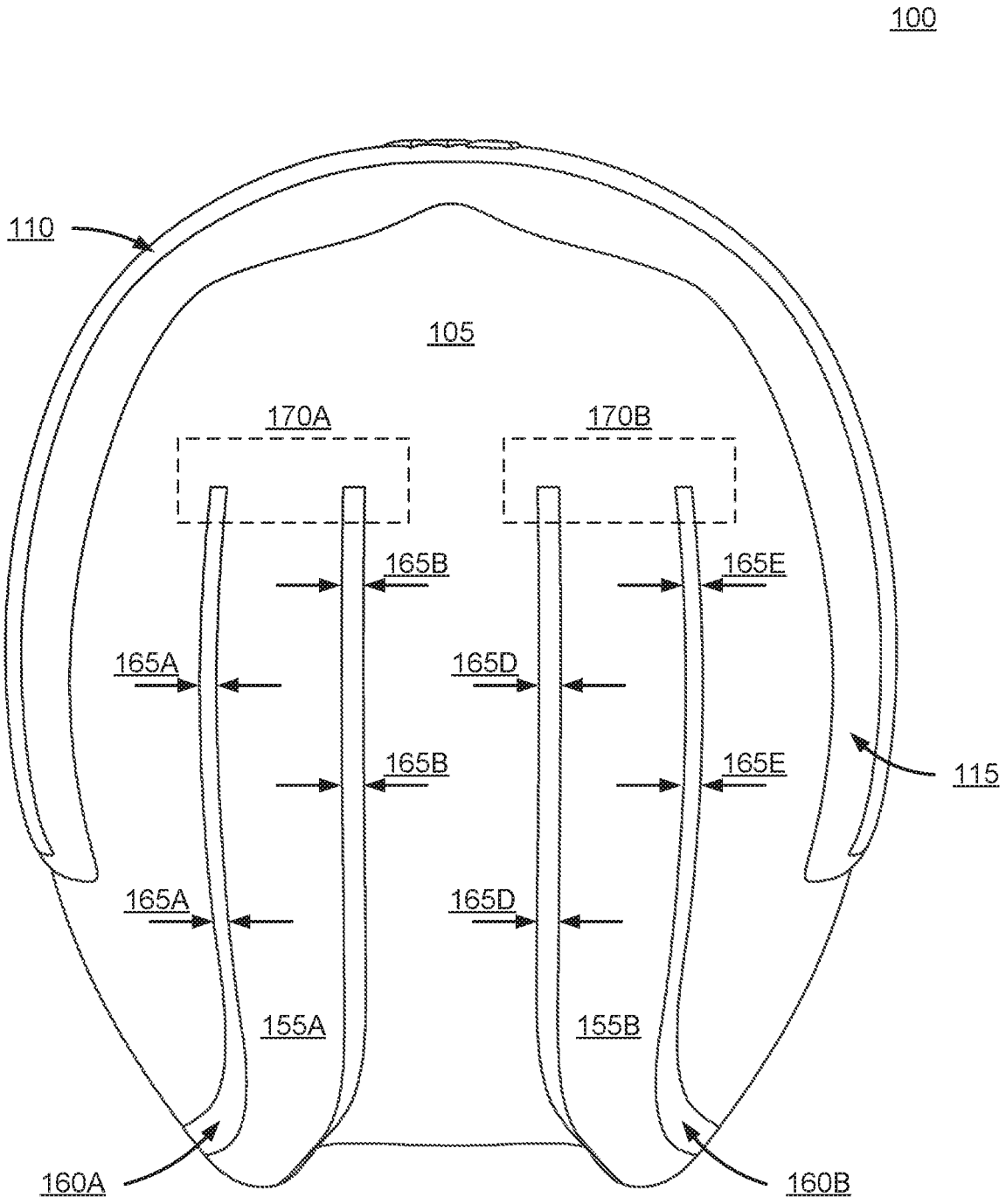
FIG. 4B is a rotated top view of the helmet of FIG. 1A, according to one embodiment.
Figure 4C:
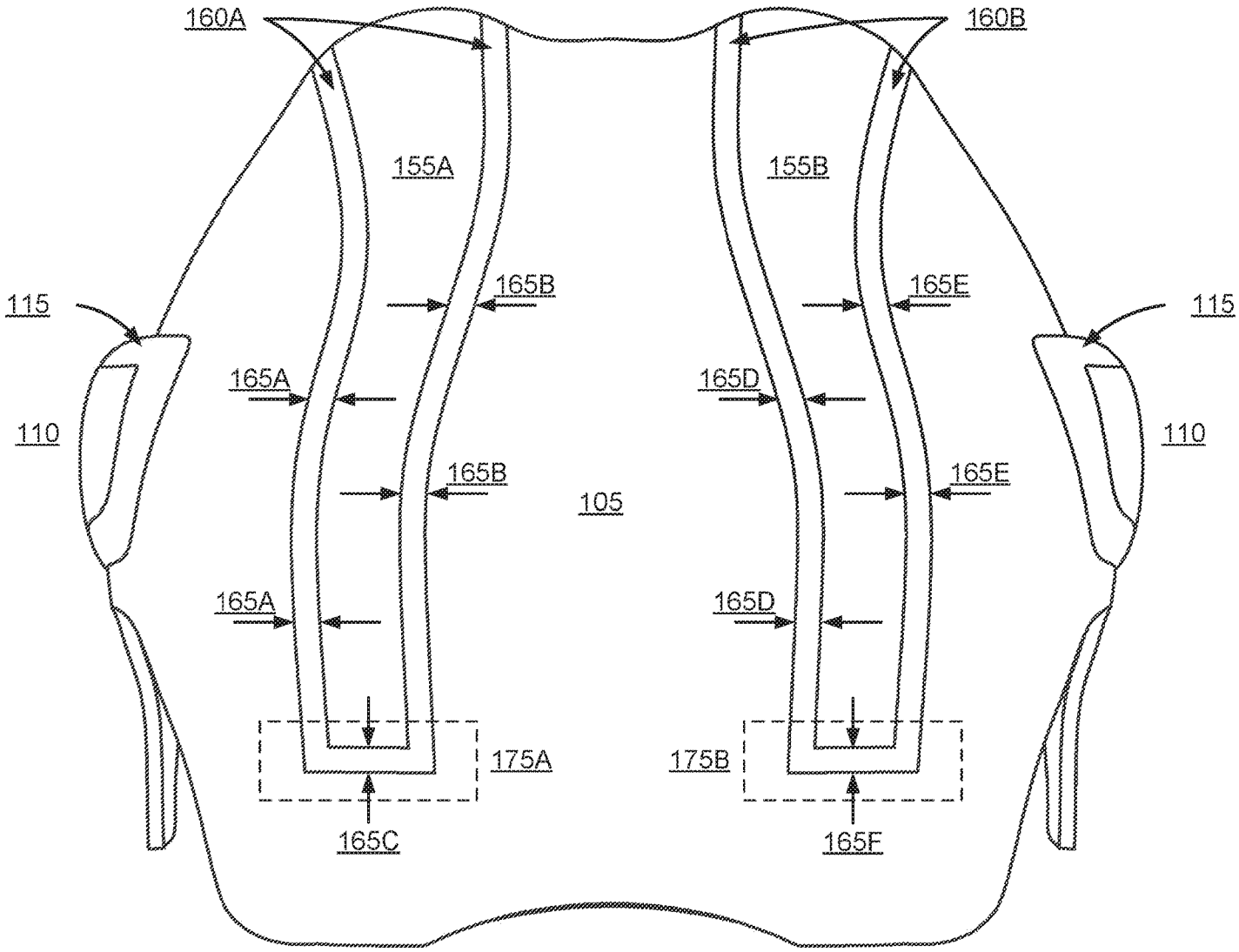
FIG. 4C is a rear view of the helmet of FIG. 1A, according to one embodiment.

FIGS. 4A, 4B, and 4C illustrate a rear perspective view, a top plan view, and a rear elevation view, respectively, of the helmet 100, according to one embodiment. In addition to the shell 105, the brim 110, and the flexible structure 115, the helmet 100 further includes two ridges 155A, 155B (collectively referred to as ridges 155) and two additional flexible structures 160A. 160B (collectively referred to as flexible structures 160). Because these three figures illustrate various views of the same components (e.g., the shell 105, the ridges 155, and the additional flexible structures 160), certain aspects of these components will be described below with reference to all three of these figures.

In the illustrated embodiment, each ridge 155A. 155B has a curved, elongated shape that extends from a first end 170A. 170B at the top of the helmet 100 (corresponding to the top of the user's head) to a second end 175A, 175B near the bottom rear edge of the helmet 100 (corresponding to the occipital region of the user's head). Furthermore, the illustrated embodiment includes two separate ridges 155A, 155B positioned symmetrically, with the first ridge 155A on the left side of the helmet 100 and the second ridge 155B on the right side of the helmet 100. In other embodiments, the helmet 100 may include a different number of ridges (e.g., three ridges, with a first ridge on the left, a second ridge on the right, and a third ridge in the middle), shorter ridges (e.g., the ridges may start and end on the back side of the helmet 100 without extending to the top of the helmet 100), or ridges with a different orientation (e.g., horizontal ridges). In still other embodiments, the helmet may include longer ridges. For example, the ridges may traverse the entire length of the helmet from the bottom edge of the helmet, near the occipital region of the user's head, across the top (similar to the embodiment in FIG. 1D), and optionally continuing to the front where the flexible structure joins the shell to the brim.

The ridges 155 are joined to the shell 105 by the additional flexible structures 160. Similar to the brim 110, the ridges 155 are sized and shaped to provide separation gaps 165A through 165F (collectively referred to as separation gaps 165) between the ridges 155 and the shell 105, and the flexible structures 160 are placed between the separation gaps 165. In the illustrated embodiment, each ridge 155 is directly joined to the shell 105 only at the first end 170A. 170B. Meanwhile, the separation gaps 165 surround each ridge on the other three sides. For example, the first ridge 155A has a left vertical edge (adjacent to the left separation gap 165A), a right vertical edge (adjacent to the right separation gap 165B), and a bottom horizontal edge (adjacent to the bottom separation gap 165C). Similarly, the second ridge 155B has a left vertical edge (adjacent to the left separation gap 165D), a right vertical edge (adjacent to the right separation gap 165E), and a bottom horizontal edge (adjacent to the bottom separation gap 165F). In another embodiment, each ridge 155A, 155B is also joined directly to the shell at the second end 175A. 175B (i.e., the bottom separation gaps 165C, 165F are omitted). In still another embodiment, the ridges 155 are not joined directly to the shell 105 at the first ends 170A, 170B; instead, there is a top separation gap (occupied by the additional flexible structures 160A, 160B) separating edges of the ridges 155 from the shell 105.

In still another embodiment, the brim is omitted and the helmet includes one or more raised ridges that protrude at least several millimeters above the outer surface of the shell and extend lengthwise from the front of the helmet to the back of the helmet. An embodiment with the ridges arranged in this manner may be used, for example, as a cycling helmet.

In the illustrated embodiment, the ridges 155 are formed of the first material (i.e., the same material as the shell 105) and are directly joined to the shell 105 at their respective first ends 170A, 170B. In other embodiments, the ridges 155 are formed of a fourth material which is different from the first material. In these embodiments, the fourth material may still have material properties similar to those of the first and second materials. For example, the fourth material may also have a high rigidity and a high impact resistance compared to the third material.

The ridges 155 are joined to the shell 105 in a manner that causes the ridges 155 to protrude from the outer surface in the rear portion of the shell 105, which means broad area impacts to the back of the helmet 100 make contact with the ridges 155 instead of the shell 105.

Figure 5B:
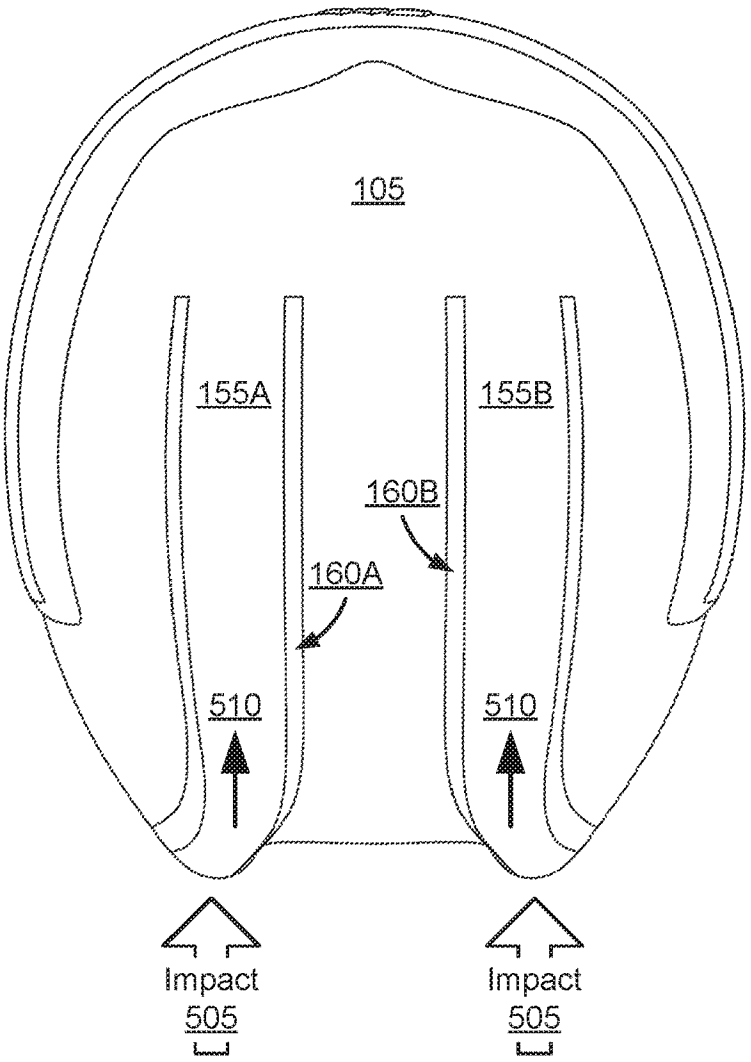
FIG. 5B is a top view illustrating a rear impact on the ridges of the helmet, according to one embodiment of the invention The figures depict various embodiments of the present invention for purposes of illustration only.
Figure 5A:
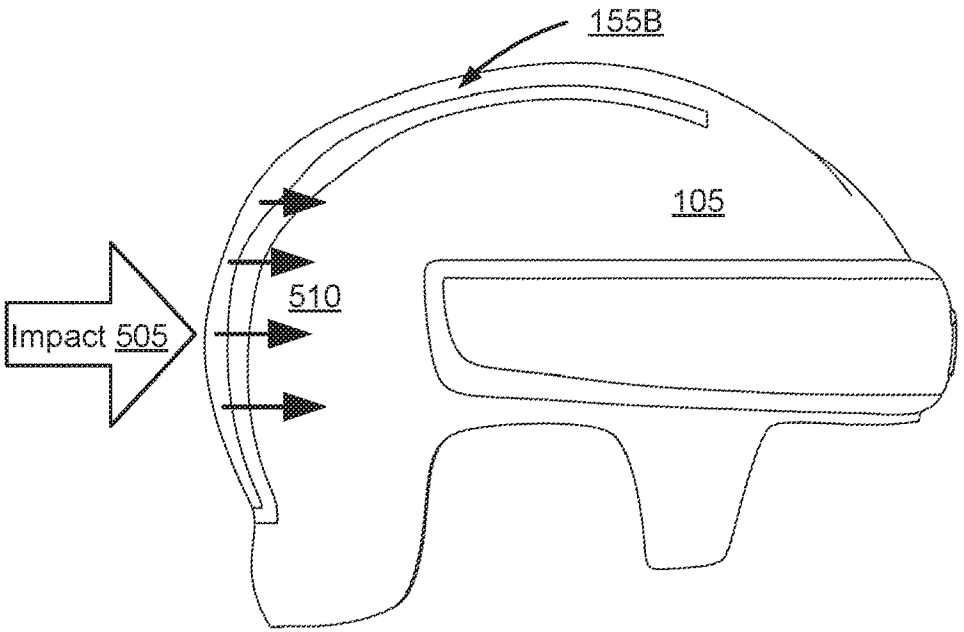
FIG. 5A is a right side view illustrating a rear impact on the ridges of the helmet, according to one embodiment.

FIGS. 5A and 5B are a side elevation view and a top plan view, respectively, of a rear impact 505 on the ridges 155 of the helmet 100. For example, the impact 505 could represent a player falling backward onto the back of his head. When the helmet 100 is subject to the rear impact 505 shown in FIGS. 5A and 5B, an impact object is likely to make contact with the ridges 155. The impact 505 causes the ridges 155 to move in translation 510 toward the user's head, and this motion 510 causes deformation in the additional flexible structures 160. Similar to the brim 110 and the flexible structure 115, the deformation in the additional flexible structures 160 allows the ridges 155 to move in translation relative to the shell 105, which reduces the motion of the shell 105 and attenuates the force of the impact 505 to the shell 105.

Although the foregoing description 100 describes a helmet 100 in which both the brim 110 and the ridges 155 are joined to the shell 105 (on at least some of their edges) with flexible structures 115 and 160, other embodiments of the helmet may include some but not all of these features. For example, a helmet may include a brim joined to a shell with a flexible structure, but with conventional ridges that are formed into the shape of the shell (or with the ridges being omitted). As another example, a helmet may include ridges joined to the shell with flexible structures, but with a conventional brim that is formed into the shape of the shell (or with the brim being omitted).

In one embodiment, the helmet 100 is manufactured with an additive manufacturing process (e.g., 3D printing) that is capable of depositing different materials in each layer or multiple materials in a single layer. In other embodiments, the shell 105 (with the ridges 155 directly joined to the shell 105) and the brim 110 are manufactured separately (e.g., via injection molding or 3D printing), and a plastic welding process is then used to join the brim 110 to the shell 105 by filling the separation gaps 120 and 165 with the third material to form the flexible structures 115 and 160. In embodiments where the ridges 155 are not directly joined to the shell 105 (i.e., the ridges are surrounded by a separation gap on all four sides), the ridges 155 are also manufactured separately and then joined to the shell 105 via the plastic welding process.

In an alternative embodiment, the shell, brim, and flexible structure are all formed of the same material, but the material properties of the material and the dimensions (e.g., thickness) of each component are selected so that the flexible structure still has a higher flexibility than the other components. Thus, the brim in this embodiment can still move relative to the shell and attenuate impact forces. Additionally or alternatively, a helmet in this embodiment may further include ridges and additional flexible structures formed of the same material and with dimensions that are similarly selected to allow the ridges to move relative to the shell and attenuate impact forces. For example, the material may have an ultimate tensile strength similar to or greater than the ultimate tensile strength of ABS (e.g., between 30 and 100 MPa) and a greater elongation to break than ABS (e.g., the material may have an elongation to break between 10% and 400%). These material properties allow the flexible structure to be manufactured at a relatively low thickness. In this example, the flexible structure has a thickness of a few tenths of a millimeter (e.g., between 0.1 and 0.5 mm) while the shell and the brim have a significantly higher thickness (e.g., between 1.0 and 5.0 mm). The inherent lack of material resulting from the low thickness of the flexible structure results in a flexibility that is similar to the flexibility of a thicker flexible structure formed with a more flexible material (such the third material described above). This combination of material properties and dimensions allows the entire helmet to be manufactured from a single material while still retaining many of the desirable properties described herein, such as the ability for the flexible structure to attenuate impact forces.

Although the description in this disclosure is provided with reference to a helmet, in other embodiments the structural components described herein may be applied to other forms of protective headgear that cover a smaller portion of the user's head than a helmet. For example, a headband may include a flexible structure that allows a first portion of the headband to move relative to a second portion of the headband to help attenuate impact forces. As another example, a pair of eye goggles may include a flexible structure that allows each eye covering (or a portion of each eye covering) to move relative to one or more other portions of the goggles. In these embodiments, the protective headgear may include multiple distinct components fastened together (e.g., with buttons, clips, or straps).

The foregoing description of the embodiments of the invention has been presented for the purpose of illustration; it is not intended to be exhaustive or to limit the invention to the precise forms disclosed. Persons skilled in the relevant art can appreciate that many modifications and variations are possible in light of the above disclosure.

All dimensions, materials, and specific numbers shown in the embodiments are given only by way of example, in order to aid the understanding of the invention; none of them are meant to limit the present invention, unless it is explicitly stated so.

Finally, the language used in the specification has been principally selected for readability and instructional purposes, and it may not have been selected to delineate or circumscribe the inventive subject matter. It is therefore intended that the scope of the invention be limited not by this detailed description, but rather by any claims that issue on an application based hereon. Accordingly, the disclosure of the embodiments of the invention is intended to be illustrative, but not limiting, of the scope of the invention, which is set forth in the following claims.

What is claimed is:

1. A helmet configured to be worn on a head of a user, the head having a forehead, said helmet comprising:

a shell formed of a material, the shell shaped and configured to receive the head of the user;

a brim formed of a material, wherein the brim protrudes from an outer surface of the shell; and a flexible structure formed of a material, disposed between the brim and shell such that an impact to the brim causes deformation of the flexible structure and thus the brim moves relative to the shell.

2. The helmet of claim 1, wherein the material of the shell, the material of the brim and the material of the flexible structure are a same type of material.

3. The helmet of claim 1, wherein the material of the shell has material properties, the material of the brim has material properties, and wherein the material of the flexible structure has material properties, and wherein the material properties of the shell are different than the material properties of the brim or the material properties of the flexible structure, or wherein the material properties of the brim are different than the material properties of the flexible structure.

4. The helmet of claim 1, wherein the shell comprises an inner surface with a concave shape, the helmet further comprising a compressible inner layer joined to the inner surface.

5. The helmet of claim 1, wherein the brim extends to portions of the helmet configured to cover a temple of the user.

6. The helmet of claim 1, wherein the material of the flexible structure has a first flexibility, the material of the shell has a second flexibility, and the material of the brim has a third flexibility, and wherein the first flexibility is greater than the second flexibility, or the first flexibility is greater than the third flexibility.

7. The helmet of claim 1, wherein the material of the flexible structure comprises an ultimate tensile strength greater than 20 MPa.

8. The helmet of claim 1, wherein the material of the shell, the material of the brim, and the material of the flexible structure each have an elongation to break greater than 10%.

9. The helmet of claim 1, wherein the flexible structure has a thickness of between 0.1 mm and 0.5 mm.

10. The helmet of claim 1, further comprising a first ridge, the first ridge comprises a shape extending from a first end at a portion of an outer surface of the shell configured to cover a top region of the head of the user to a second end at another portion of the outer surface of the shell configured for covering an occipital region of the head of the user, the helmet further comprising a cutout positioned in a front region of the shell configured to be adjacent the forehead of the user when the helmet is worn by the user, the helmet farther comprising a separation gap disposed between the shell and the brim.

11. The helmet of claim 10, wherein the first ridge comprises a left vertical edge, a right vertical edge, and a bottom horizontal edge, wherein the bottom horizontal edge is disposed at the second end, wherein the first end is joined to the shell, and wherein the flexible structure is positioned in the separation gap disposed between edges of the brim adjacent the shell, wherein the separation gap is adjacent the left vertical edge, the right vertical edge, and the bottom horizontal edge.

12. The helmet of claim 10, wherein the brim has a top horizontal edge, a bottom horizontal edge, a left end, and a right end, wherein the left end and the right end are joined to the shell, and wherein the separation gap is adjacent the top horizontal edge and the bottom horizontal edge.

13. The helmet of claim 10, wherein the brim is disposed at least partially in the cutout.

14. The helmet of claim 10, wherein the flexible structure is positioned in the separation gap disposed between edges of the brim adjacent the shell and edges of the shell disposed around the cutout.

15. The helmet of claim 1, further comprising:

a first ridge protruding from a rear portion of an outer surface of the shell configured to cover a back region of the head of the user; and a second flexible structure disposed in a second separation gap disposed between edges of the first ridge adjacent the shell and the outer surface of the rear portion of the shell, wherein the second flexible structure is coupled to the first ridge and the shell such that an impact to the first ridge causes deformation of the second flexible structure such that the first ridge moves relative to the shell.

16. The helmet of claim 15, further comprising:

a second ridge protruding from the rear portion of the outer surface of the shell configured to cover the back region of the head of the user; and a third flexible structure disposed in a third separation gap disposed between edges of the second ridge adjacent the shell and the outer surface of the rear portion of the shell, wherein the third flexible structure is coupled to the second ridge and the shell such that an impact to the second ridge causes deformation of the third flexible structure such that the second ridge moves relative to the shell.

* * * * *